US009834837B2

(12) United States Patent
Larsson et al.

(10) Patent No.: US 9,834,837 B2
(45) Date of Patent: Dec. 5, 2017

(54) METHOD AND STEEL COMPONENT

(71) Applicant: AKTIEBOLAGET SKF, Göteborg (SE)

(72) Inventors: Staffan Larsson, Göteborg (SE); Walter Datchary, Göteborg (SE); Peter Neuman, Göteborg (SE)

(73) Assignee: AKTIEBOLAGET SKF, Gothenburg (SE)

( * ) Notice: Subject to any disclaimer, the term of this patent is extended or adjusted under 35 U.S.C. 154(b) by 391 days.

(21) Appl. No.: 14/422,738

(22) PCT Filed: Aug. 19, 2013

(86) PCT No.: PCT/SE2013/000125

§ 371 (c)(1),
(2) Date: Feb. 20, 2015

(87) PCT Pub. No.: WO2014/031051

PCT Pub. Date: Feb. 27, 2014

(65) Prior Publication Data

US 2015/0218688 A1 Aug. 6, 2015

(30) Foreign Application Priority Data

Aug. 21, 2012 (SE) ..... 1200504-7

(51) Int. Cl.

| | |
|---|---|
| ***C21D 1/06*** | (2006.01) |
| ***C21D 1/18*** | (2006.01) |
| ***C21D 1/20*** | (2006.01) |
| ***C23C 8/22*** | (2006.01) |
| ***C23C 8/80*** | (2006.01) |
| ***C21D 6/00*** | (2006.01) |
| ***C23C 8/46*** | (2006.01) |
| ***C23C 8/66*** | (2006.01) |

(52) U.S. Cl.

CPC ..... *C23C 8/80* (2013.01); *C21D 1/06* (2013.01); *C21D 1/18* (2013.01); *C21D 1/20* (2013.01); *C21D 6/00* (2013.01); *C23C 8/22* (2013.01); *C23C 8/46* (2013.01); *C23C 8/66* (2013.01)

(58) Field of Classification Search

CPC ... C21D 1/06; C21D 1/18; C21D 1/20; C21D 6/00; C23C 8/22; C23C 8/46; C23C 8/66

See application file for complete search history.

(56) References Cited

U.S. PATENT DOCUMENTS

| | | | | |
|---|---|---|---|---|
| 2011/0073222 | A1 | 3/2011 | Strandell et al. | |
| 2012/0018050 | A1 | 1/2012 | Kubota et al. | |
| 2013/0000788 | A1* | 1/2013 | Nagata | C21D 1/20 148/219 |

FOREIGN PATENT DOCUMENTS

| | | | |
|---|---|---|---|
| CN | 101868558 | A | 10/2010 |
| WO | 2011122315 | A1 | 10/2011 |
| WO | 2011122315 | A1 | 2/2014 |

* cited by examiner

*Primary Examiner* — Colleen Dunn

(74) *Attorney, Agent, or Firm* — Bryan Peckjian; SKF USA Inc. Patent Dept.

(57) ABSTRACT

A method for heat treating a steel component, which comprises the steps of: (a) carburizing the steel component with a carbon potential above 1.0, (b) carburizing the steel component with a carbon potential above 0.6, (c) quenching the steep component, and (d) subjecting the steel component to a bainitic treatment.

5 Claims, 2 Drawing Sheets

METHOD AND STEEL COMPONENT

CROSS REFERENCE TO RELATED APPLICATIONS

This is a National Stage Application claiming the benefit of International Application Number PCT/SE2013/000125 filed on 19 Aug. 2013 (19 Aug. 2013), which claims the benefit of Sweden Patent Application Serial Number 1200504-7, filed on 21 Aug. 2012 (21 Aug. 2012), both of which are incorporated herein by reference in their entireties.

TECHNICAL FIELD

The present invention concerns a method for heat treating a steel component, and a steel component that has been subjected to such a method.

BACKGROUND OF THE INVENTION

Carburizing is a heat treatment process in which iron or steel absorbs carbon liberated when the metal is heated in the presence of a carbon bearing material with the intent of making the metal harder. Depending on the carburizing time and temperature, an affected area can vary in carbon content. Longer carburizing times and higher temperatures lead to greater carbon diffusion into the metal as well as an increased depth of carbon diffusion. When the iron or steel is cooled rapidly by quenching, the higher carbon content on the outer surface becomes hard via the transformation from austenite to martensite while the core remains soft and tough as a ferritic and/or pearlitic microstructure. Carburizing is most commonly used on low-carbon workpieces which are placed in contact with a high-carbon gas, liquid or solid. It produces a hard workpiece surface with a case hardness depth of up to 10 mm and a tough and ductile workpiece core.

The volume change that occurs between the carburized area (case) and the base material (core) of a metal creates compressive residual stress (CRS). It can be desirable to create maximal compressive stress in a metal. Over-carburizing a metal may however result in a risk of quench cracking, high surface retained austenite, dimensional instability due to martensite contraction, and low CRS.

SUMMARY OF THE INVENTION

An object of the invention is to provide an improved method for heat treating a steel component.

This object is achieved by a method that comprises the steps of a) carburizing the steel component with a carbon potential above 1.0 and then b) carburizing the steel component with a carbon potential above 0.6, c) quenching the steel component, and, when the steel component has cooled down, d) subjecting the steel component to a bainitic treatment, whereby these steps are preferably carried out sequentially.

The method is based on the insight that the carburizing carbon potential and the hardening cycle used when heat treating a steel component influences the steel component's compressive residual stress and consequently its physical properties. It has been found that using a lower carbon potential in the diffusion phase of the carburizing process, (step b)) results in a lower carbon content in the steel component, which is beneficial in terms of physical properties, such as compressive residual stresses, rotating bending fatigue (RBF) (structural fatigue), and toughness. If a high level of CRS is desired, a carbon potential of 0.6-1.2, preferably 0.6-0.9, or 0.65-0.85 should be used in the diffusion phase of the carburizing process, (step b)). Bainitic quenching (step d)) further increases the CRS.

According to an embodiment of the invention step a) is carried out with a carbon potential of 1.0-1.4.

According to a further embodiment of the invention step a) and/or step b) is/are carried out at a temperature of 940-1000° C., or more specifically at 940-980° C., such as at 970° C.

According to an embodiment of the invention step d) is carried out at a temperature of 200-240° C., or more specifically at 215-220° C.

According to another embodiment of the invention the steel component comprises steel with a carbon content of 0.1 to 0.4 weight %, such as 18CrNiMo7-6.

According to a further embodiment of the invention the method comprises the steps of e) cooling the steel component and f) tempering the steel component at a temperature of 160-240° C., or more specifically at 190-210° C., such as 200° C.

According to an embodiment of the invention the steel component comprises or constitutes a rolling element or roller, or a steel component for an application in which is subjected to alternating Hertzian stresses, such as rolling contact or combined rolling and sliding, such as a slewing bearing or a raceway for a bearing. The steel component may include or constitute gear teeth, a cam, shaft, bearing, fastener, pin, automotive clutch plate, tool, or a die. The steel component may for example constitute at least part of a roller bearing, a needle bearing, a tapered roller bearing, a spherical roller bearing, a toroidal roller bearing or a thrust bearing. The steel component may be used in automotive wind, marine, metal producing or other applications which require high wear resistance.

According to an embodiment of the invention the method is used to improve at least one of the following properties of a steel component: compressive residual stress (CRS), rotating bending fatigue (structural fatigue), load-bearing capacity, wear resistance, corrosion resistance, hardness, tribological properties, toughness, service life.

The present invention also concerns a steel component that has been heat treated using a method according to an embodiment of the invention, which exhibits an average CRS of 150-200 MPa or higher, measured between 0.5-1.0 mm from the surface using the bore-hole method.

BRIEF DESCRIPTION OF THE DRAWINGS

The present invention will hereinafter be further explained by means of non-limiting examples with reference to the appended figures where.

It should be noted that the drawings have not been drawn to scale and that the dimensions of certain features have been exaggerated for the sake of clarity.

DETAILED DESCRIPTION OF EMBODIMENTS

Figure 1:
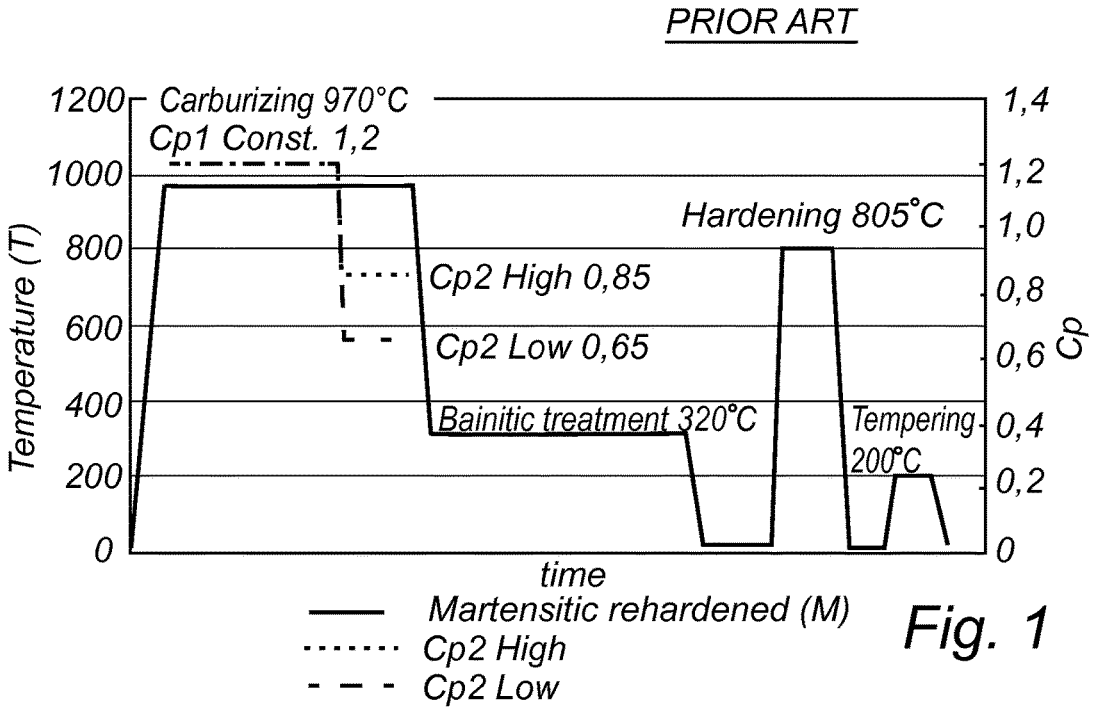
FIG. 1 shows a heat treatment method according to the prior art.

FIG. 1 shows a heat treatment cycle according to the prior art. A steel component is firstly carburized at a temperature of 970° C. with a carbon potential of 1.2 and then with a carbon potential of 0.65-0.85. The steel component is then quenched and subjected to a hydrogen effusion treatment in the upper bainitic temperature regime. The steel component is cooled and then re-hardened and tempered. It was found that steel components that were heat treated in this way exhibited a relatively low level of CRS, namely an average CRS of 50-100 MPa, measured between 0.5-1.0 mm from the surface.

Figure 2:
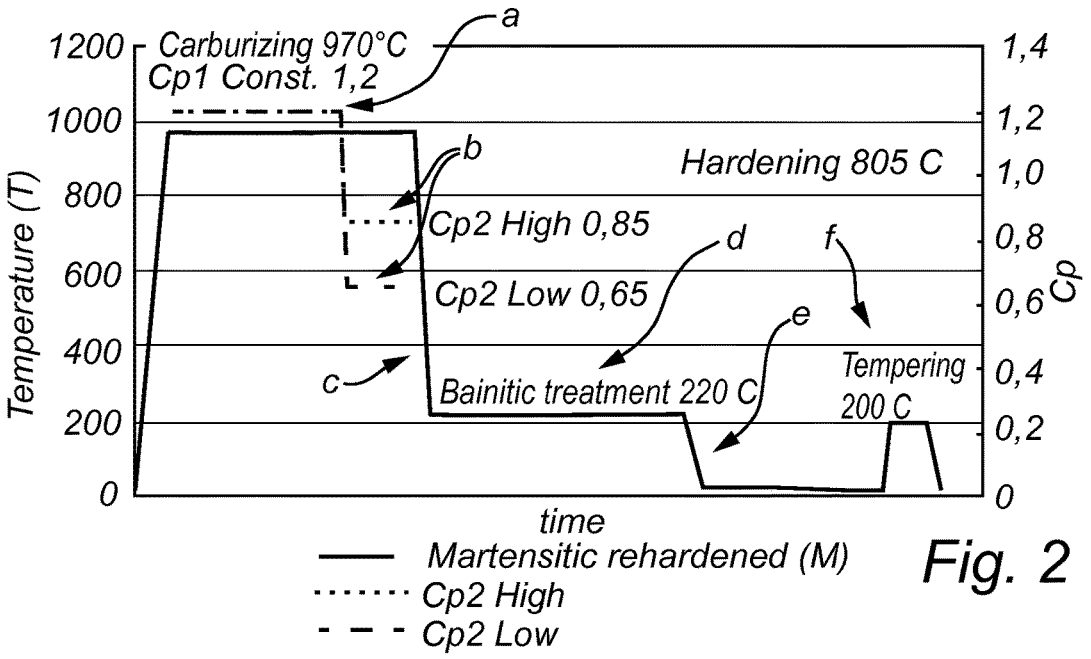
FIG. 2 shows a heat treatment method according to an embodiment of the present invention.

FIG. 2 shows a heat treatment method according to an embodiment of the invention. The method comprises the steps of: a) carburizing a steel component comprising steel with a carbon content of 0.1 to 0.4 weight % at a temperature of 970° C. with a carbon potential above 1.0, such as 1.0-1.4 in a first carburizing step, and b) carburizing the steel component with a carbon potential above 0.6, such as of 0.6-1.2, preferably 0.6-0.9, in a second carburizing step. Using this lower carbon potential in step b), which is sufficient to achieve sufficient hardness in the as-quenched state before tempering, is beneficial in terms of CRS and RBF levels in the heat treated steel component.

The method comprises the step of c) quenching the steel component in an oil or salt bath with bath temperatures selected to achieve the optimum properties with acceptable levels of dimensional change. Hot oil/salt bath quenching can be used to minimize distortion of intricate parts. The steel component is then d) subjected to a bainitic treatment at a temperature of 220° C., e) cooled, to room temperature for example, and f) tempered at a temperature of 200° C.

Due to the lower carbon content in the steel component, there is a lower risk of quench cracks, and the steel component will have an increased toughness. A low retained austenite level is achieved so that a lower tempering temperature can be used while maintaining a high CRS level. Furthermore, dimensional instability, caused by martensite contraction due to long thermal exposures, will be decreased allowing a lower tempering temperature to be used.

Low temperature tempering (step f)) may be carried out to toughen the steel component, for example at a temperature of 200° C. After tempering, the component is cooled, to room temperature for example, and may then be used in any application in which it is likely to be subjected to stress, strain, impact and/or wear under a normal operational cycle.

Steel components heat treated using a method according to an embodiment of the invention exhibited an average CRS of 150-200 MPa or higher, measured between 0.5-1.0 mm from the surface using the bore-hole method. The CRS of a steel component is namely increased by lowering the carbon potential in the diffusion phase of the carburizing, step b) and changing the quenching mode from martensitic quenching, to bainitic quenching. Steel components heat treated using a method according to an embodiment of the invention also contained finer grains than steel components subjected to a heat treatment according to the prior art.

Less time is needed to carry out the method shown in FIG. 2 than the method shown in FIG. 1 since the process step of hardening the steel component after a bainitic treatment at 320° C. is excluded. Shorter lead times and cost reduction may therefore be possible.

Using a method according to the present invention also allows the CRS and hardness of a steel component to be tailored according to requirements, by selecting a suitable carbon potential during carburizing steps a) and/or b).

Steel components subjected to a method according to an embodiment of the present invention may be used with or without subsequent grinding operations.

Figure 3:
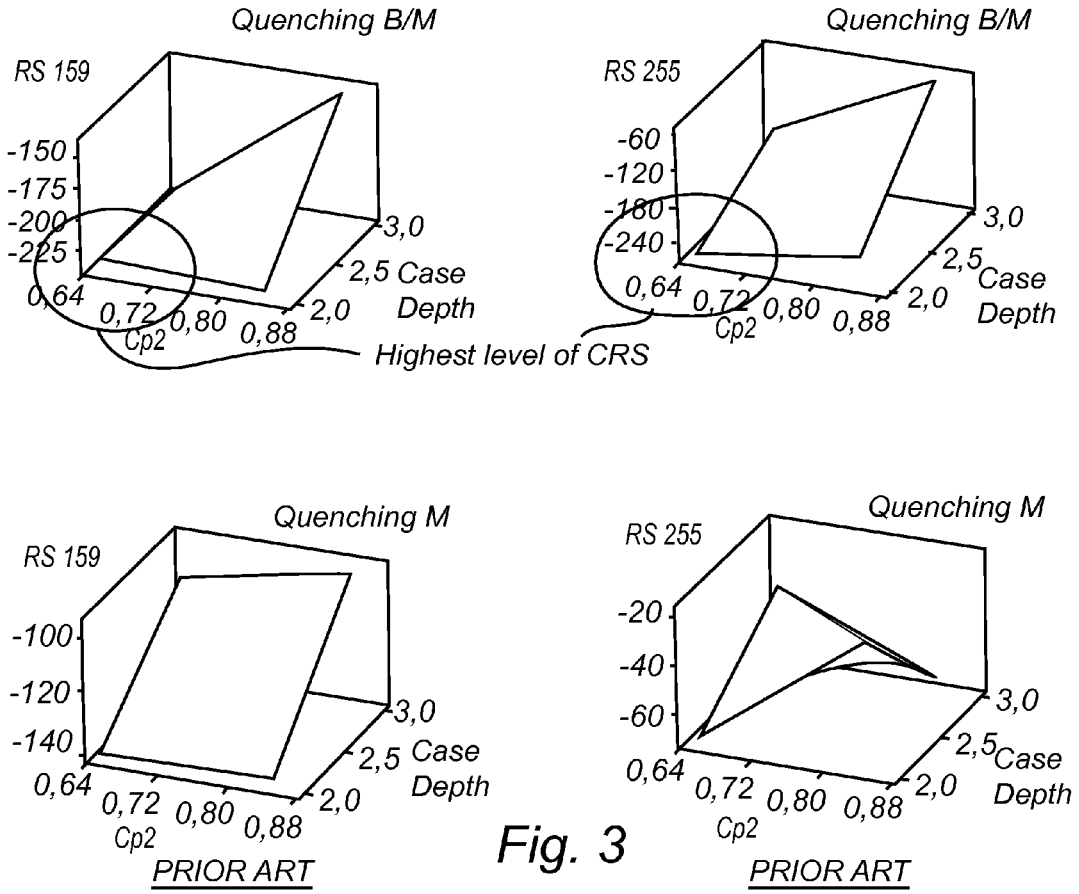
FIG. 3 shows compressive residual stress of steel samples subjected to a heat treatment according to the prior art and a heat treatment method according to an embodiment of the present invention.

FIG. 3 shows the compressive residual stress of steel samples subjected to a heat treatment according to the prior art (diagrams at the bottom left and bottom right of FIG. 3) and a heat treatment method according to an embodiment of the present invention (diagrams at the top left and bottom right of FIG. 3).

The top left diagram of FIG. 3 shows the influence of the carbon potential during the diffusion phase of the carburizing step b) on CRS and the case depth for 18CrNiMo7-6 steel subjected to a method according to the present invention.

The top right diagram of FIG. 3 shows the influence of the carbon potential during the diffusion phase of the carburizing step b) on CRS and the case depth for 18NiCrMo14-6 steel subjected to a method according to the present invention.

It can be seen from the top left and top right diagrams, that a carbon potential between 0.65 and 0.85 during the diffusion phase of the carburizing step b) results in the highest level of CRS.

The bottom left diagram of FIG. 3 shows the influence of the carbon potential during the diffusion phase of the carburizing step b) on CRS and the case depth for 18CrNiMo7-6 steel subjected to a heat treatment according to the prior art. The bottom right diagram of FIG. 3 shows the influence of the carbon potential during the diffusion phase of the carburizing step b) on CRS and the case depth for 18NiCrMo14-6 steel subjected to a heat treatment according to the prior art. It can be seen that the method according to the present invention results in steel components having a higher level of CRS than steel components that have been subjected to a heat treatment according to the prior art.

Figure 4:
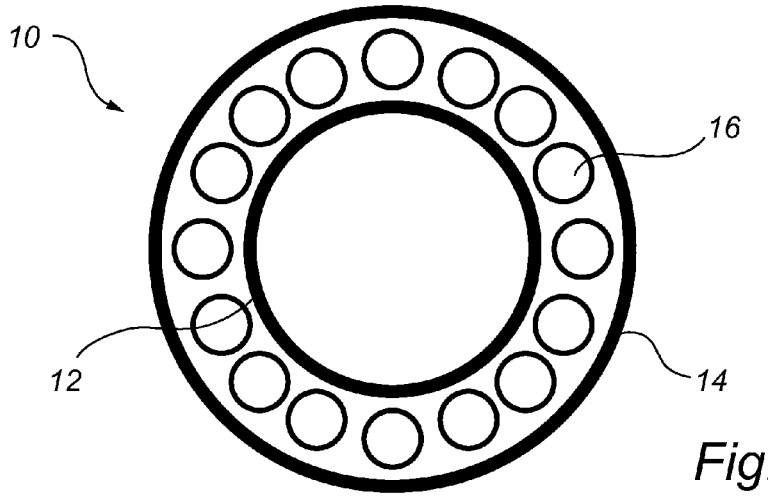
FIG. 4 shows a steel component according to an embodiment of the invention.

FIG. 4 shows an example of a steel component according to an embodiment of the invention, namely a rolling element bearing 10 that may range in size from 10 mm diameter to a few meters diameter and have a load-carrying capacity from a few tens of grams to many thousands of tonnes. The bearing 10 according to the present invention may namely be of any size and have any load-carrying capacity. The bearing 10 has an inner ring 12 and an outer ring 14 and a set of rolling elements 16. The inner ring 12, the outer ring 14 and/or the rolling elements 16 of the rolling element bearing 10, and preferably at least part of the surface of all of the rolling contact parts of the rolling element bearing 10 may be subjected to a method according to the present invention.

Such steel components 10, 12, 14, 16 which have been subjected to a method according to an embodiment of the present invention will exhibit enhanced bearing performance, such as rolling contact fatigue, and consequently have an increased service life due to the presence of an increased level of compressive residual stress.

Further modifications of the invention within the scope of the claims would be apparent to a skilled person.

The invention claimed is:

1. A method for heat treating a steel bearing roller or a steel bearing rolling element, the method comprising steps of, in the following sequence:

a) carburizing the steel bearing roller or the steel bearing rolling element with a first carbon potential above 1.0, b) carburizing the steel bearing roller or the steel bearing rolling element with a second carbon potential above 0.6 and lower that the first carbon potential, c) quenching the steel bearing roller or the steel bearing rolling element, d) subjecting the steel bearing roller or the steel bearing rolling element to a bainitic treatment at a temperature of 200-240° C., e) cooling the steel bearing roller or the steel bearing rolling element, and f) tempering the steel bearing roller or the steel bearing rolling element at a temperature of 160-240° C.

2. The method according to claim 1, wherein the step of carburizing the steel bearing roller or the steel bearing rolling element with a carbon potential above 1.0 is carried out with a carbon potential of between 1.0-1.4.

3. The method according to claim 1, wherein the step of carburizing the steel bearing roller or the steel bearing rolling element with a carbon potential above 0.6 is carried out with a carbon potential of between 0.6-1.2.

4. The method according to claim 1, wherein at least one of the step of carburizing the steel bearing roller or the steel bearing rolling element with a carbon potential above 1.0 and the step of carburizing the steel component bearing roller or the steel bearing rolling element with a carbon potential above 0.6 is carried out at a temperature of 940-1000° C.

5. The method according to claim 1, wherein the said steel bearing roller or the steel bearing rolling element comprises 18CrNiMo7-6 steel.

* * * * *